US007676317B2

(12) United States Patent
Aliakbarzadeh et al.

(10) Patent No.: US 7,676,317 B2
(45) Date of Patent: Mar. 9, 2010

(54) METHOD AND DEVICE FOR DETERMINING A CORRECTIVE VALUE USED FOR INFLUENCING AN AIR/FUEL RATIO

(75) Inventors: Reza Aliakbarzadeh, Regensburg (DE); Manfred Klepatsch, Pettendorf (DE)

(73) Assignee: Continental Automotive GmbH, Hannover (DE)

( * ) Notice: Subject to any disclaimer, the term of this patent is extended or adjusted under 35 U.S.C. 154(b) by 180 days.

(21) Appl. No.: 11/885,267

(22) PCT Filed: Feb. 8, 2006

(86) PCT No.: PCT/EP2006/050741

§ 371 (c)(1),
(2), (4) Date: Aug. 28, 2007

(87) PCT Pub. No.: WO2006/092353

PCT Pub. Date: Sep. 8, 2006

(65) Prior Publication Data

US 2008/0201057 A1 Aug. 21, 2008

(30) Foreign Application Priority Data

Feb. 28, 2005 (DE) ..... 10 2005 009 101

(51) Int. Cl.
*F02D 41/30* (2006.01)

(52) U.S. Cl. ..... 701/103; 701/114

(58) Field of Classification Search ..... 701/103, 701/104, 109, 110, 114; 123/673–675, 443–445, 123/691, 692, 696
See application file for complete search history.

(56) References Cited

U.S. PATENT DOCUMENTS

| | | | | |
|---|---|---|---|---|
| 5,056,308 | A * | 10/1991 | Kume et al. | 60/276 |
| 5,485,382 | A * | 1/1996 | Seki et al. | 701/109 |
| 5,533,332 | A * | 7/1996 | Uchikawa | 60/274 |
| 5,570,574 | A * | 11/1996 | Yamashita et al. | 60/276 |
| 5,598,702 | A * | 2/1997 | Uchikawa | 60/274 |
| 5,661,971 | A | 9/1997 | Waschatz et al. | |
| 5,730,111 | A * | 3/1998 | Kaji et al. | 123/673 |
| 5,758,310 | A | 5/1998 | Kato | |
| 5,794,604 | A * | 8/1998 | Suzuki et al. | 123/673 |
| 5,884,613 | A * | 3/1999 | Kitamura et al. | 123/696 |
| 6,029,641 | A * | 2/2000 | Suzuki et al. | 123/673 |
| 6,116,227 | A * | 9/2000 | Yoshioka et al. | 123/674 |
| 6,325,056 | B1 | 12/2001 | Weining et al. | |
| 6,370,473 | B1 * | 4/2002 | Yasui et al. | 701/109 |

(Continued)

FOREIGN PATENT DOCUMENTS

DE 4236008 C2 4/1994

(Continued)

*Primary Examiner*—Stephen K Cronin
*Assistant Examiner*—Johnny H Hoang
(74) *Attorney, Agent, or Firm*—King & Spalding L.L.P.

(57) ABSTRACT

The invention relates to a method for the cylinder-selective control of an air/fuel mixture to be burnt in a multi-cylinder internal combustion engine, in which the lambda values for different cylinders or groups of cylinders are separately sensed and controlled, and also relates to a multi-cylinder internal engine suitable for carrying out the method. In accordance with the invention, the lambda values of the individual cylinders or groups of cylinders are simultaneously controlled to different required values using an integrating I-control proportion with variable integrator slope and/or a differentiating D-control proportion.

8 Claims, 3 Drawing Sheets

U.S. PATENT DOCUMENTS

| | | | | |
|---|---|---|---|---|
| 6,371,096 | B1 * | 4/2002 | Ohsaki et al. | 123/688 |
| 6,415,779 | B1 * | 7/2002 | Colomby | 123/674 |
| 6,539,915 | B1 * | 4/2003 | Wild et al. | 123/295 |
| 6,823,839 | B2 * | 11/2004 | Yasui et al. | 123/339.12 |
| 6,885,933 | B2 * | 4/2005 | Lederer et al. | 701/109 |
| 6,925,372 | B2 * | 8/2005 | Yasui | 701/109 |
| 7,134,428 | B2 * | 11/2006 | Rosel | 123/687 |
| 7,305,299 | B2 * | 12/2007 | Yasui et al. | 701/109 |
| 7,490,596 | B2 * | 2/2009 | Yasui et al. | 123/697 |
| 7,536,244 | B2 * | 5/2009 | Kunihiro et al. | 701/34 |
| 2002/0121268 | A1 | 9/2002 | Graf et al. | |
| 2005/0022797 | A1 | 2/2005 | Ikemoto et al. | |

FOREIGN PATENT DOCUMENTS

| | | | |
|---|---|---|---|
| DE | 199 03 721 | C1 | 7/2000 |
| DE | 10206906 | C1 | 11/2003 |
| DE | 102004036739 | A8 | 7/2005 |
| WO | 9635048 | A1 | 11/1996 |

* cited by examiner

METHOD AND DEVICE FOR DETERMINING A CORRECTIVE VALUE USED FOR INFLUENCING AN AIR/FUEL RATIO

CROSS REFERENCE TO RELATED APPLICATIONS

This application is the US National Stage of International Application No. PCT/EP2006/050741, filed Feb. 8, 2006 and claims the benefit thereof. The International Application claims the benefits of German application No. 10 2005 009 101.6 filed Feb. 28, 2005, both of the applications are incorporated by reference herein in their entirety.

FIELD OF THE INVENTION

The invention relates to a method and device for determining a corrective value used for influencing an air/fuel ratio in a respective cylinder of an internal combustion engine comprising a number of cylinders, injection valves that are assigned to the cylinders and apportion fuel, and an exhaust gas probe, which is disposed in an exhaust manifold and the test signal of which is characteristic of the air/fuel ratio in the respective cylinder.

BACKGROUND OF THE INVENTION

Ever stricter legal requirements relating to admissible pollutant emissions from motor vehicles, in which internal combustion engines are arranged, require maintaining the pollutant emissions as low as possible during operation of the internal combustion engine. This can occur on the one hand by reducing the pollutant emissions, which are produced during the combustion of the air/fuel mixture in the respective cylinder of the internal combustion engine. On the other hand, exhaust gas after treatment systems are used in internal combustion engines, which convert the pollutant emissions which are generated during the combustion process of the air/fuel mixture in the respective cylinders, into harmless substances. To this end, exhaust gas catalytic converters are used, which convert carbon monoxide, carbon dioxide and nitrogen oxide into harmless substances. Both the targeted influencing of the generation of pollutant emissions during the combustion as well as the conversion of the pollutant components at a high level of efficiency by means of an exhaust gas catalytic converter require a very precisely adjusted air/fuel ratio in the respective cylinder.

DE 199 03 721 C1 discloses a method for an internal combustion engine having a number of cylinders for the cylinder-selective control of an air/fuel mixture to be combusted, wherein the lambda values for different cylinders or cylinder groups are identified and controlled separately. To this end, a probe evaluation unit is provided, in which a time-resolved evaluation of the exhaust gas probe signal is carried out and a cylinder-selective lambda value is thus determined for each cylinder of the internal combustion engine. An individual controller is assigned to each cylinder, said controller being embodied as a PI or PID controller, the control variable of which is a cylinder-specific lambda value and the command variable of which is a cylinder-specific target value of the lambda. The actuating variable of the respective controller then influences the injection of fuel in the respectively assigned cylinder.

SUMMARY OF INVENTION

The object of the invention is to create a method and a device for determining a corrective value used for influencing an air/fuel ratio, which enable/s a precise determination of the corrective value and therefore a precise control of an internal combustion engine.

The object is achieved by the features of the claims.

The invention is characterized by a method and a corresponding device for determining a corrective value used for influencing an air/fuel ratio in a respective cylinder of an internal combustion engine comprising a number of cylinders. Injection valves which apportion fuel are assigned to the cylinders. An exhaust gas probe is disposed in an exhaust manifold. Its test signal is characteristic of the air/fuel ratio in the respective cylinder. The test signal is detected at a predetermined sampling crankshaft angle, relative to a reference position of the piston of the respective cylinder, and assigned to the respective cylinder. A control value used to influence the air/fuel ratio in the respective cylinder is determined by means of a controller in each instance as a function of the test signal detected for the respective cylinder.

A first adaptive value is determined as a function of the control value if predetermined first conditions are fulfilled, including a predetermined first temperature range of a temperature, which is representative of a temperature of the respective injection valve.

A second adaptive value is determined as a function of the control value if predetermined second conditions are fulfilled, including a predetermined second temperature range of the temperature, which is representative of the temperature of the respective injection valve. The corrective value for influencing the air/fuel ratio in the respective cylinder is determined as a function of the first and/or second adaptive value as a function of the temperature, which is representative of the temperature of the respective injection valve. The first and second temperature ranges preferably have no mutual overlapping region. The temperature can be an injection valve temperature for instance or also a coolant temperature.

In accordance with the invention, the corrective value which applies to the respective cylinder can be very precisely determined, which is in particular especially advantageous if injection characteristics of the different injection valves change as a function of the temperature of the respective injection valves. This is particularly relevant in conjunction with injection valves with piezo actuators.

According to an advantageous embodiment of the invention, an upper temperature limit value of the first temperature range is smaller than a catalytic converter start temperature value of the temperature, which is representative of the temperature of the respective injection valve, with the catalytic converter start temperature value being characteristic of a temperature-related operational readiness of the exhaust gas catalytic converter. The catalytic converter start temperature value of the temperature is representative of the temperature of the respective injection valve if the operational readiness of the exhaust gas catalytic converter is achieved.

This is advantageous in that a separate, first adaptive value is determined in particular during cold operation of the internal combustion engine and thus in the event that the corrective value is used to control the internal combustion engine already at a very early point in time in respect of the start of the internal combustion engine, a very precise cylinder-specific adjustment of the air/fuel ratio is possible in the respective cylinders. This can thus effect the pollutant emissions generated by the internal combustion engine during cold operation in a particularly advantageous manner and can thus contribute significantly to reducing emissions, since in the case of a still cold operation of the internal combustion engine, no or only an insignificant conversion of the pollutants can be carried out by means of the exhaust gas catalytic converter of the internal combustion engine.

According to a further advantageous embodiment of the invention, the corrective value is determined by a predetermined weighting of the first and second adaptive value, if the temperature, which is representative of the temperature of the respective injection value, lies between the first and second temperature ranges. In this way, when the weighting is suitably predetermined, the corrective value can also be very precisely determined between the first and second temperature range with only minimal adaptive values, such as the first and second adaptive value.

In a further advantageous embodiment of the invention, a third or further adaptive values are determined as a function of the control value if predetermined third or further conditions are fulfilled, which include a predetermined third or further temperature ranges of the temperature, which is representative of the temperature of the respective injection valve. The corrective value used for influencing the air/fuel ratio in the respective cylinder is then determined as a function of the third and/or further adaptive values as a function of the temperature, which is representative of the temperature of the respective injection valve. In this way, an even more precise determination of the corrective value can thus be carried out for instance.

In this context, it is advantageous if an upper temperature limit value of the third or further temperature ranges is smaller than the catalytic converter start temperature value of the temperature, which is representative of the temperature of the respective injection value. In this way, particularly with the use of the corrective value for controlling an internal combustion engine, the pollutant emissions are very significantly reduced.

BRIEF DESCRIPTION OF THE DRAWINGS

Exemplary embodiments of the invention are described in more detail below with reference to the schematic drawings, in which.

Elements of the same design or function are characterized across all the figures with the same reference character.

DETAILED DESCRIPTION OF INVENTION

Figure 1:
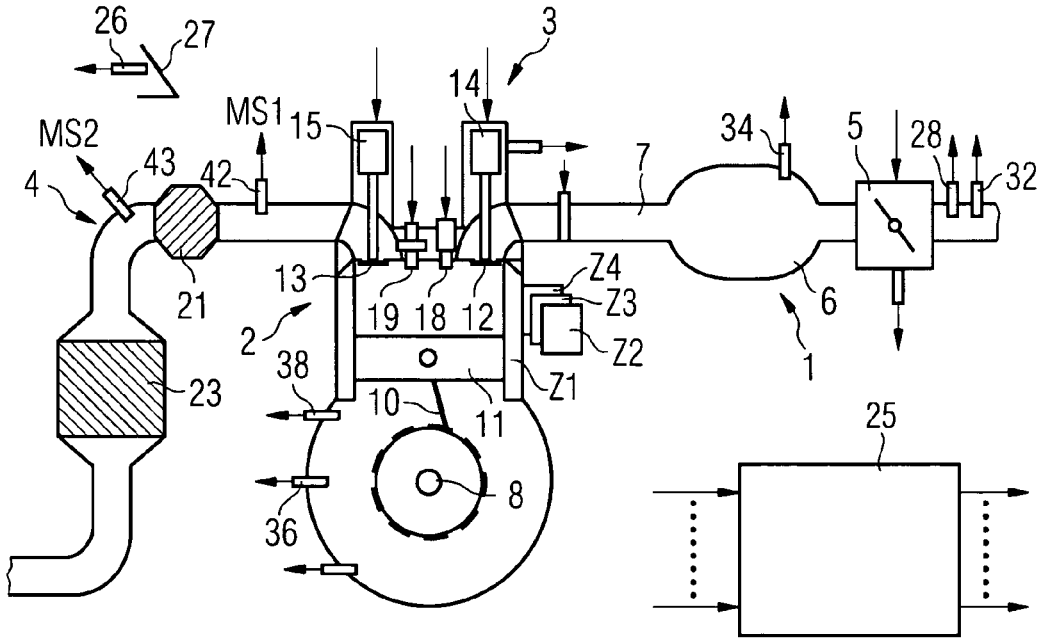
FIG. 1 shows an internal combustion engine with a control device

An internal combustion engine (FIG. 1) comprises an intake manifold 1, an engine block 2, a cylinder head 3, and an exhaust manifold 4. The intake manifold 1 preferably comprises a throttle valve 5, also an accumulator 6 and an intake manifold 7, which is guided to a cylinder Z1 via an inlet channel into the engine block 2. The engine block 2 also comprises a crankshaft 8, which is coupled to the piston 11 of the cylinder Z1 by way of a connecting rod 10.

The cylinder head 3 comprises a valve mechanism having a gas inlet valve 12 and a gas outlet valve 13. The cylinder head 3 also comprises an injection valve 18 and a spark plug 19. Alternatively, the injection valve 18 can also be arranged in the induction manifold 7.

An exhaust gas catalytic converter, which is embodied as a three-way catalytic converter 21, is arranged in the exhaust gas manifold 4. Furthermore, a further exhaust gas catalytic converter is also preferably arranged in the exhaust gas manifold, which is embodied as a NOx catalytic converter 23.

A control device 25 is provided, to which sensors are assigned, which detect different measured variables and determine the value of the measured variables in each instance. The control device 25 determines actuating variables as a function of at least one of the measured variables, said actuating variables then being converted into one or a number of control signals for controlling the control elements by means of corresponding actuators. The control device 25 can also be referred to as a device for controlling the internal combustion engine or as a device for determining a corrective value.

The sensors are a pedal position sensor 26, which detects the position of an accelerator 27, an air mass sensor 28, which detects an air mass flow upstream of the throttle valve 5, a first temperature sensor 32, which detects an intake air temperature, an induction manifold pressure sensor 34, which detects an induction manifold pressure in the accumulator 6, a crankshaft angle sensor 36, which detects a crankshaft angle, to which is then assigned a rotary speed N. Furthermore, a second temperature sensor 38 is provided, which detects a coolant temperature TCO. Furthermore, a further temperature sensor is arranged in the injection valve 18, said temperature sensor detecting the injection valve temperature. If the injection valve 18 includes a piezo actuator, this can then form the further temperature sensor.

Furthermore, a first exhaust gas probe 42 is provided, which is arranged upstream of the three-way catalytic converter 21 and which detects a residual oxygen content of the exhaust gas and the test signal MS1 of which is characteristic of the air/fuel ratio in the combustion chamber of the cylinder Z1 and upstream of the first exhaust gas probe, prior to oxidation of fuel, referred to below as the air/fuel ratio in the cylinders Z1-Z4. Furthermore, a second exhaust gas probe 43 is provided, which is arranged downstream of the three way catalytic converter 21 and which detects a residual oxygen content of the exhaust gas and the test signal of which is characteristic of the air/fuel ratio in the internal combustion chamber of the cylinder Z1 and upstream of the second exhaust gas probe 43 prior to oxidation of the fuel, referred to below as the air/fuel ratio downstream of the exhaust gas catalytic converter.

The first exhaust gas probe 42 is preferably a linear lambda probe. The second exhaust gas probe 43 is a binary lambda probe. It may however also be a linear lambda probe.

Depending on the embodiment of the invention, any arbitrary subset if the said sensors may be available or additional sensors may also be present.

The control elements are the throttle valve 5 for instance, the gas inlet and gas outlet valves 12, 13, the injection valve 18 or the spark plug 19.

Aside from cylinder Z1, further cylinders Z2 to Z4 are still also provided, to which corresponding control elements and if necessary sensors are also assigned.

Figure 2:
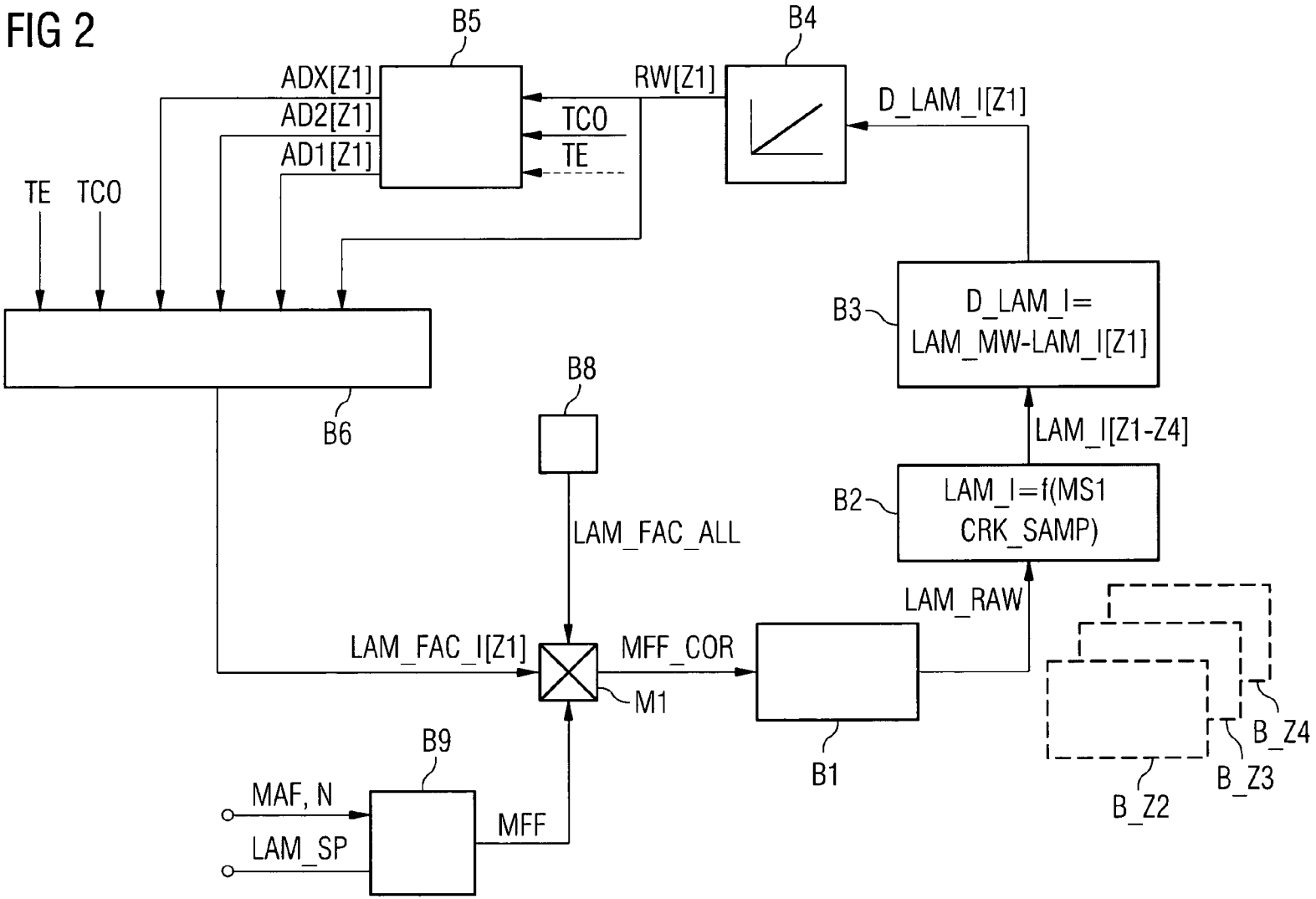
FIG. 2 shows a block diagram of the control device

Blocks of the control device 25 which are relevant to the invention are shown with reference to the block diagram in FIG. 2.

A block B1 corresponds to the internal combustion engine. The test signal MS1 emitted by the exhaust gas probe 42 is routed to a block B2. In block B2, an assignment of the test signal MS1 of the first exhaust gas probe 42, which is current at this time instant, to the respective cylinder-specifically detected air/fuel ratio LAM_I [Z1-Z4] is carried out at each determined sampling crankshaft angle CRK_SAMP relative to a reference position of the respective piston 11 of the respective cylinder Z1-Z4. The reference position of the respective piston 11 is preferably its upper dead center.

In a block B3, an average air/fuel ratio LAM_MW is determined by averaging the cylinder-specifically detected air/fuel ratio LAM_I[Z1-Z4]. Furthermore, in block B3, a cylinder-specific air/fuel ratio deviation D_LAM_I[Z1-Z4] is determined. This is then fed to block B4. The block B4 comprises a controller, the output variable of which is a control value RW[Z1-Z4] used for influencing the air/fuel ratio in the respective cylinder Z1-Z4. The controller comprises an integral component, it can however also comprise a so-called $I^2$-component or proportional component. The controller of the block B4 can also be referred to as a cylinder-specific lambda controller.

Figure 3:
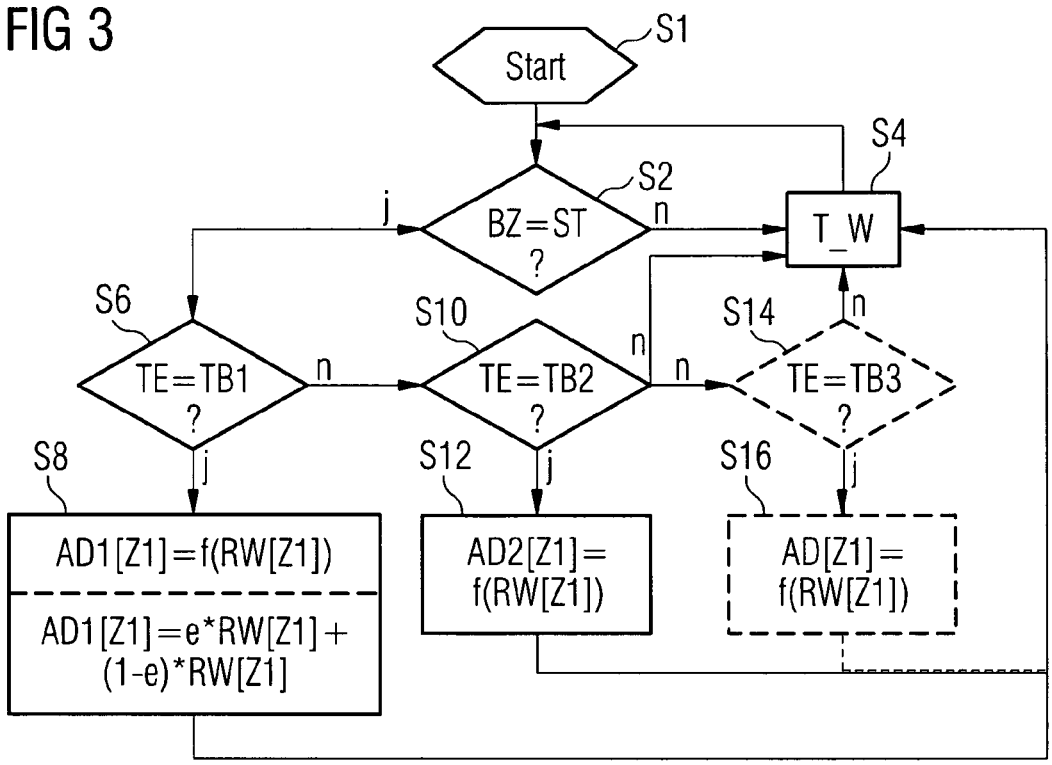
FIGS. 3 and 4 show flow diagrams of programs, which are processed in the control device.

A block B5 is designed to determine a first, second or further adaptive values AD1[Z1-Z4], AD2[Z1-Z4], ADX[Z1-Z4] and in fact as a function of a temperature, which is representative of the temperature of the respective injection valve 18. The injection valve temperature TE is preferably supplied to the block B5 as a temperature which is representative of the temperature of the respective injection valve 18. Alternatively, also to this end, the coolant temperature TCO can be fed to block B5 for instance. The block B5 preferably comprises a program, which is described in more detail below with reference to FIG. 3.

Block B6 is designed to determine a corrective value LAM_ FAC_I[Z1-Z4] and in fact as a function of the first, second or further adaptive value AD1[Z1-Z4], AD2[Z1-Z4], ADX[Z1-Z4], the temperature, which is representative of the temperature of the respective injection valve 18 and if necessary of the control value RW[Z1-Z4]. The block B6 preferably comprises a program, which is explained in more detail below with reference to FIG. 4.

A lambda controller is provided in block B8, the actuating variable of which is an air/fuel ratio LAM_SP which is predetermined for all cylinders Z1-Z4 of the internal combustion engine and the control variable of which is the average air/fuel ratio LAM_MW. The control variable of the lambda controller is a lambda control-factor LAM_FAC_ALL. The lambda controller thus has the object of adjusting the predetermined air/fuel ratio, viewed across all cylinders of the internal combustion engine.

Alternatively, this can herewith also be achieved in that in block B3, the cylinder-specific air/fuel ratio deviation D_LAM_I is determined from the difference of the air/fuel ratio which is predetermined for all cylinders Z1-Z4 of the internal combustion engine and of the cylinder-specific air/fuel ratio LAM_I[Z1-Z4]. In this case, block B8 can be omitted.

In block B9, a fuel quantity MFF to be apportioned is determined as a function of an air quantity MAF in the respective cylinder Z1-Z4 and if necessary the speed N and the air/fuel ratio LAM_SP which is predetermined for all cylinders of the internal combustion engine.

At the multiplier point M1, a corrected fuel quantity MFF_COR to be apportioned is determined by multiplying the fuel quantity MFF to be apportioned, the lambda control factor LAM_FAC_ALL and the corrective value LAM_FA_I[Z1-Z4]. A control signal is then generated as a function of the corrected fuel quantity MFF_COR to be apportioned, with which the respective injection valve 18 is controlled.

Figure 4:
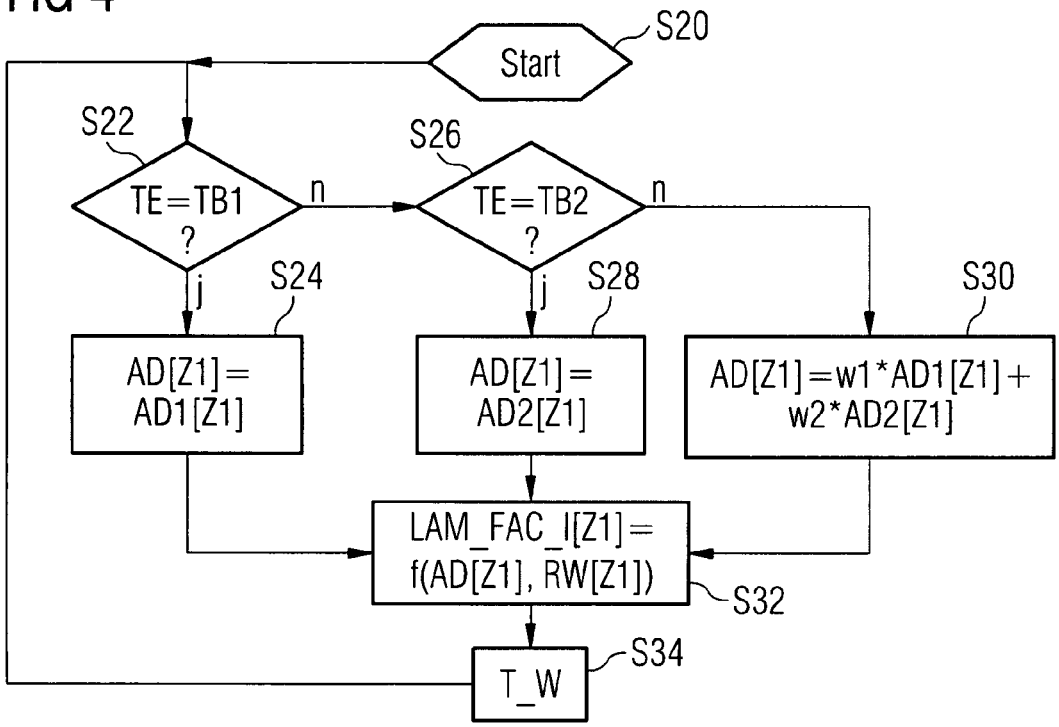

In addition to the controller structure illustrated in the block diagram in FIG. 4, corresponding controller structures B-Z2 to B_Z4 are provided for the respective further cylinders Z2 to Z4 for each further cylinder Z1-Z4.

A program for block B5 is started in step S1 (see FIG. 3), in which variables can be initialized if necessary.

Step S2 monitors whether a quasi-stationary operating status ST is present as the operating status BZ of the internal combustion engine. The quasi-stationary operating status ST can then be available for instance if the speed N is only subject to predetermined minimal fluctuations, with it being decisive in this content that respective exhaust gas packets, induced by the combustion of the air/fuel mixture in the respective cylinders Z1-Z4, can be assigned to the respective cylinder Z1-Z4 with reference to the test signal MS of the first exhaust gas probe 42 with sufficient accuracy.

If the condition of step S2 is not fulfilled, the processing is continued in step S4, in which the program is paused for a predetermined waiting time TW or is also paused for a predetermined crankshaft angle range, before the processing is continued again in step S2.

If the condition of step S2 is contrastingly fulfilled, step S6 monitors whether the injection valve temperature TE lies in a first temperature range TB1. The first temperature range TB1 is thus predetermined such that its upper temperature limit is smaller than a catalytic converter start temperature value of the injection valve temperature. If the condition of step S6 is fulfilled, the first adaptive value AD1[Z1-Z4] is determined in step S8 as a function of the current control value RW[Z1]. This can be carried out for instance with the calculation specification specified in step S8, with e referring to a renewed factor, which is preferably smaller than 1.

If the condition of step S6 is contrastingly not fulfilled, step S10 monitors whether the current injection valve temperature TE lies within a second temperature range TB2. A lower temperature limit value of the second temperature range TB2 is preferably predetermined such that it is larger than the catalytic converter start temperature value. The second temperature range can comprise the entire temperature range of the possible operating temperatures in a particularly simple manner, said overall temperature range being greater than the lower temperature limit value.

If the condition of step S10 is fulfilled, the second adaptive value AD2[Z1] is determined in step S12 as a function of the current control value RW[Z1]. This is carried out for instance according to the procedure of step S8. The processing is then continued in step S4. If the condition of step S10 is not fulfilled, either the processing can be continued in step S4 or an additional step S14 can be provided, in which it is monitored whether the current injection valve temperature TE lies within a further temperature range. If the condition of step S14 is then not fulfilled, the processing is continued in step S4. If the condition of step S14 is then contrastingly fulfilled, the current control value RW[Z1] is assigned in step S16 to the further adaptive values ADZ[Z1] according to the procedure of step S8.

A program for block B6 is started in step S20 (FIG. 4), in which variables can be initialized if necessary.

Step S22 monitors whether the current injection valve temperature TE lies in the first temperature range TB1. If this is the case, the first adaptive value AD[Z1] is assigned to an adaptive value AD[Z1-Z4] in step S24. If the condition of step S22 is contrastingly not fulfilled, step S26 monitors whether the injection valve temperature TE lies in the second temperature range TB2. If this is the case, the second adaptive value AD2[Z1] is assigned to the adaptive value AD[Z1] in step S28.

If the condition of step S26 is contrastingly not fulfilled, the sum of a first and second term is assigned in step S30 to the adaptive value AD[Z1], with the first term being the product of a first weighting value W1 and first adaptive value AD1[Z1] and the second term being the product of the second weighting value W2 and the second adaptive value AD2[Z1].

Figure 5:
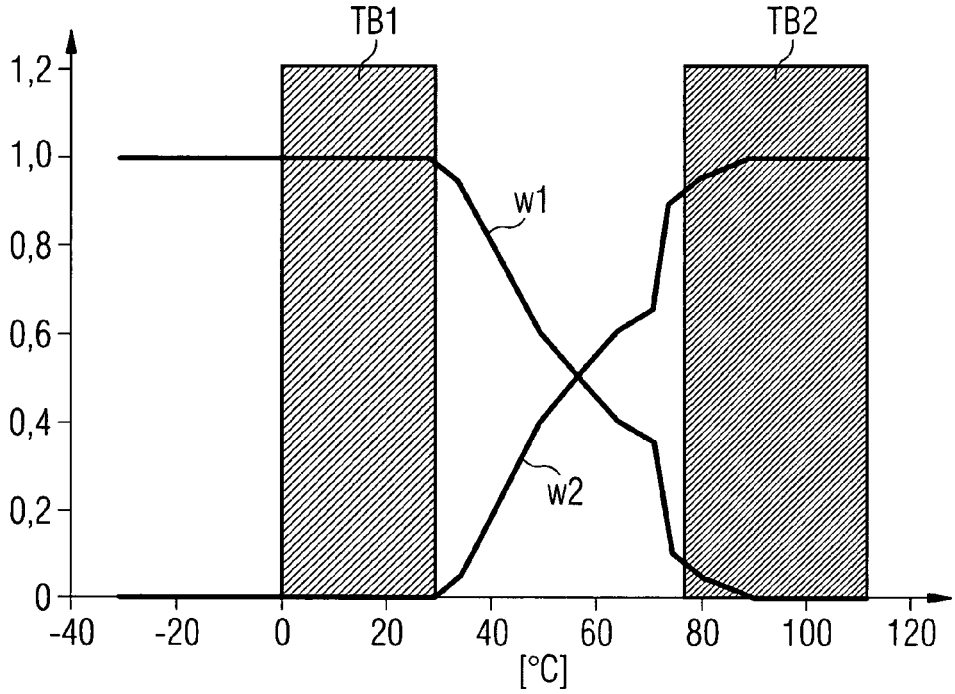
FIG. 5 shows a temperature-dependent curve of the first and second weighting values.

In this case, if the condition of step S26 is not fulfilled, the injection valve temperature TE is required to lie outside both the first and second temperature range TB1, TB2, but nevertheless between the first and second temperature ranges TB1, TB2. The first and second weighting values w1, w1 are preferably predetermined as a function of the respective temperature, which is representative of the temperature of the respective injection valve, in other words the injection valve temperature TE for instance or, as is shown with reference to FIG. 5, the coolant temperature TCO. In this case, the injection valve temperature TE is replaced by the coolant temperature TCO in steps S6, S10, S14, S22 and S26.

The correction value LAM_FAC_I[Z1] is then determined in step S32. This is carried out as a function of the adaptive value AD[Z1] and preferably also as a function of the control value RW[Z1]. By way of example, the calculation can however be carried out in step S32, independent of the control value RW[Z1], almost simultaneously with a start of the internal combustion engine, at which the exhaust gas probe 42 is not yet read for operation. By way of example, the adaptive value AD[Z1] and the control value RW[Z1] can be added in step S22. In step S34, the program subsequently pauses for the given waiting time T_W or the predetermined crankshaft angle.

Blocks B5 and B6 allow the strict emission limit values, particularly during cold start-up, to be guaranteed on the one hand. Furthermore, the driving behavior of the internal combustion engine during cold engine operation can however also be improved.

The invention claimed is:

1. A method for determining a corrective value (LAM_FAC_I[Z1-Z4]) used to influence an air/fuel ratio in a respective cylinder of an internal combustion engine comprising a plurality of cylinders, injection valves assigned to the plurality of cylinders to apportion fuel and an exhaust gas probe disposed in an exhaust manifold and whose test signal is characteristic of the air/fuel ratio of the respective cylinder, comprising:

detecting the test signal at a predetermined sampling crankshaft angle relative to a reference position of a piston of the respective cylinder;

determining a control value used to influence the air/fuel ratio in the respective cylinder via a controller as a function of the test signal detected for the respective cylinders;

determining a first adaptive value based on the control value, if predetermined first conditions are fulfilled, that include determining whether a temperature that represents a temperature of the respective injection valve falls within a predetermined second temperature range;

determining a second adaptive value based on the control value, if predetermined second conditions are fulfilled, that include determining whether the temperature that represents the respective injection valve falls within a predetermined second temperature range; and determining the corrective value used to influence the air/fuel ratio in the respective cylinders as a function of the first and/or second adaptive value as a function of the temperature of the respective injection valve if the temperature, which is representative of the temperature of the respective injection valve, falls within one of the first second temperature ranges; and determining the corrective value based on a predetermined weighting of the first and second adaptive value, if the temperature, which is representative of the temperature of the respective injection valve, lies between the first and second temperature ranges.

2. The method as claimed in claim 1, wherein an upper temperature limit value of the first temperature range is less than a catalytic converter start temperature value of the temperature, which is representative of the temperature of the respective injection valve, with the catalytic converter start temperature value being characteristic of a temperature-related readiness to operate the exhaust gas catalytic converter.

3. The method as claimed in claim 1, wherein if predetermined third or further conditions are fulfilled, which include a predetermined third and/or further temperature ranges of the temperature, which is representative of the temperature of the respective injection valve, a third or further adaptive values determined as a function of the control value and the corrective value used to influence the air/fuel ratio in the respective cylinder is determined as a function of the third and/or further adaptive values as a function of the temperature, which is representative of the temperature of the respective injection valve.

4. The method as claimed in claim 3, wherein an upper temperature limit value of the third or further temperature range is less than the catalytic converter start temperature value of the temperature, which is representative of the temperature of the respective injection valve.

5. A device for determining a corrective value for influencing an air/fuel ratio of an internal combustion engine having a plurality of cylinders, a plurality of injection valves assigned to the cylinders that apportion fuel and an exhaust gas probe arranged in an exhaust manifold of the engine whose test signal is characteristic of an air/fuel ratio in a respective cylinder, comprising:

a test signal detector that detects the test signal at a predetermined sampling crankshaft angle relative to a reference position of a piston of the respective cylinder;

a controller that determines a control value for influencing the air/fuel ratio in the respective cylinder as a function of the detected test signal for the respective cylinder;

a first value processor that determine a first adaptive value based on the control value if predetermined first conditions are fulfilled, which include determining whether a temperature that represents a temperature of the respective injection valve falls within a predetermined first temperature range and a second value processor that determines a second adaptive value based on the control value if predetermined second conditions are fulfilled, which include determining whether the temperature, that represents the temperature of the respective injection valve falls within a predetermined second temperature range; and a corrective value processor that:

determines the corrective value used to influence the air/fuel ratio in the respective cylinder as a function of the first and/or second adaptive value as a function of the temperature that represents the temperature of the respective injection valve if the temperature, which is representative of the temperature of the respective injection valve, falls within one of the first and second temperature ranges; and determines the corrective value based on a predetermined weighting of the first and second adaptive value, if the temperature, which is representative of the temperature of the respective injection valve, lies between the first and second temperature ranges.

6. The device as claimed in claim 5, wherein an upper temperature limit value of the first temperature range is less than a catalytic converter start temperature value of the temperature, which is representative of the temperature of the respective injection valve, with the catalytic converter start temperature value being characteristic of a temperature-related readiness to operate the exhaust gas catalytic converter.

7. The device as claimed in claim 5, wherein if predetermined third or further conditions are fulfilled, which include a predetermined third and/or further temperature ranges of the temperature, which is representative of the temperature of the respective injection valve, a third or further adaptive values determined as a function of the control value and the corrective value used to influence the air/fuel ratio in the respective cylinder is determined as a function of the third and/or further adaptive values as a function of the temperature, which is representative of the temperature of the respective injection valve.

8. The device as claimed in claim 7, wherein an upper temperature limit value of the third or further temperature range is less than the catalytic converter start temperature value of the temperature, which is representative of the temperature of the respective injection valve.

* * * * *